United States Patent [19]

Spencer

[11] Patent Number: 4,942,976

[45] Date of Patent: Jul. 24, 1990

[54] CONTAINER CLOSURE WITH SPIGOT VALVE

[75] Inventor: Steven R. Spencer, Kansas City, Mo.

[73] Assignee: Tapour, Inc., Kansas City, Mo.

[21] Appl. No.: 258,669

[22] Filed: Oct. 17, 1988

[51] Int. Cl.[5] ..... B65D 51/18

[52] U.S. Cl. ..... 220/254; 222/153; 222/501; 222/509; 222/518

[58] Field of Search ..... 220/254; 222/153, 481, 222/498, 501, 505, 507, 509, 518; 215/311

[56] References Cited

U.S. PATENT DOCUMENTS

| | | | |
|---|---|---|---|
| 3,417,962 | 12/1968 | Fuerst | 222/509 X |
| 3,459,345 | 8/1969 | Chernak et al. | 222/505 |
| 4,693,400 | 9/1987 | Frahm et al. | 222/518 |
| 4,801,053 | 1/1989 | Kaster | 222/518 |

*Primary Examiner*—Stephen Marcus
*Assistant Examiner*—Nova Stucker
*Attorney, Agent, or Firm*—Hovey, Williams, Timmons & Collins

[57] ABSTRACT

A container closure having a spigot valve and comprising a lid for the container which lid has a hole therein and a spigot valve carried by the lid in association with the hole, therebeing a shiftable sealing assembly as part of the spigot valve for opening and closing the hole, the assembly being shifted by a resilient member which is shiftable from a first position closing the hole to a second position opening the hole, therebeing a lever for shifting the resilient member between respective positions and detents for retaining the lever to hold the resilient member in the second position whereby a valve stem which depends from the resilient member and extends through the hole is retained in the open section position to permit egress of the contents of the container whether the container is in a vertical, slightly tipped condition, or in a horizonal position.

9 Claims, 1 Drawing Sheet

CONTAINER CLOSURE WITH SPIGOT VALVE

FIELD OF THE INVENTION

This invention relates to closures for liquid containers in the form of a lid having a spigot valve therein whereby the contents of the container may be dispensed through a spout controlled by the valve when the container is in either a tipped, generally vertical or a horizontal position, therebeing a shiftable resilient member controlled by swingable lever to open and close the valve and means for retaining the valve in an open condition to permit egress of the contents of the container.

DESCRIPTION OF THE PRIOR ART

Many types of closures and related valves have been developed for containers which are intended to receive and dispense liquids.

However, so far as is known, no such closures and valves have combined, in a single unit, a container closure with a spigot valve, which valve is operable when the container is in either a substantially vertical position, whereby the contents thereof may be poured therefrom as by a pitcher, or in a horizontal position, whereby the contents may be dispensed therefrom through the spigot valve by opening the valve and permitting the contents to flow by gravity through the opening provided in conjunction with a spout whereby the contents of the container may be received within a receptacle disposed below the spout of the spigot valve.

Thus, there is presented a single unitary closure with a spigot valve which may be utilized in a dual capacity; that is, it is fully operable when the container is in a substantially vertical or slightly tipped condition to pour the contents from the container, and it is also fully operable when the container is in a horizontal position.

SUMMARY OF THE INVENTION

A closure for containers which has a spigot valve as a part thereof includes a lid for the container having a hole therein, the spigot valve being carried by the lid in association with the hole. The spigot valve includes a shiftable sealing assembly for opening and closing the hole within the lid, the shifting being accomplished by a resilient circular member of rubber which is seated within a groove in a wall which surrounds the hole, which resilient means is acted upon by a lever whereby to move a valve stem which depends from the resilient means and extends through the hole, from a first position closing the hole to a second position opening the hole, the entire sealing assembly being operable whether the container is in a vertical position or a horizontal position.

DETAILED DESCRIPTION OF THE INVENTION

Figure 1:
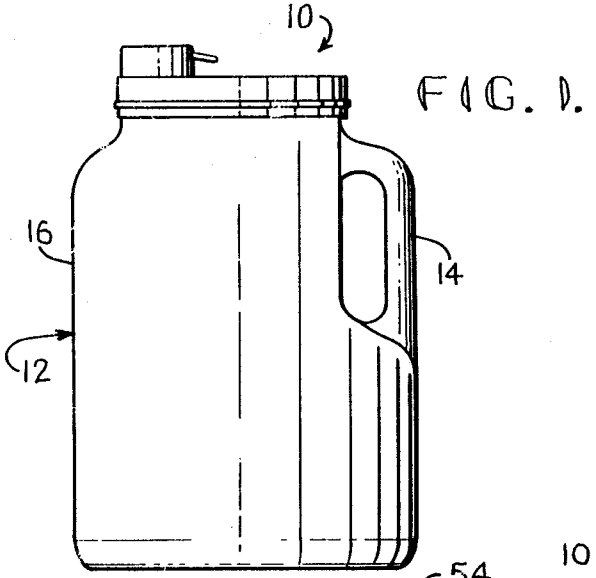
FIG. 1 is a side elevational view of a container with the closure with spigot valve placed thereon in closing relationship thereto.

The container closure with spigot valve, broadly designated by the numeral 10, is intended to act as a closure for a container, such as 12, which normally receives a liquid, such as water, tea, soda, or the like, which is to be selectively dispensed from time to time in amounts determined by the user and normally into a receptacle, such as a cup or a glass. To this end, the container 12 is provided with a handle 14 which may be used to tip the container, from the position shown in FIG. 1, to the left, whereby the container may function as a pitcher when the spigot valve is in an open condition. On the other hand, the container 12 has a flat, normally forwardmost, wall 16 whereby the container in its entirety may be placed in a horizontal position, such as on the shelf of a refrigerator, on a table, or other horizontal supporting surface, whereby the liquid to be dispensed from the container may flow out of the spigot valve in its open condition into a suitable receptacle which is placed below the container when it is in its horizontal position. Thus, the container closure with spigot valve enables the container 12 to be utilized in the form of a pitcher and also, in its horizontal position, as a dispensing container for its liquid contents through the open spigot valve.

The container closure incorporates a lid 18 which has a top wall 20 presenting a normally outermost surface 22 and a normally innermost surface 24, therebeing a depending skirt 26 which circumscribes the top wall 20 and presents a series of inwardly extending threads, such as 28, whereby the lid 18 may be screwed upon the neck of a container, such as 12, whereby to provide a closure for the container. An outwardly extending bead 30 is normally provided adjacent the lowermost edge of the skirt 26 to serve as an aid in grasping the lid 18 to place it upon or remove it from the neck of the container 12. A hole 32 is provided in wall 20 of the lid 18 whereby communication is provided to the interior of the container 12.

In the embodiment of the invention illustrated, the top wall 20 of the lid 18 also includes a wall 34 having an inner surface 36 and an outer surface 38, which wall 34 circumscribes the hole 32.

Figure 2:
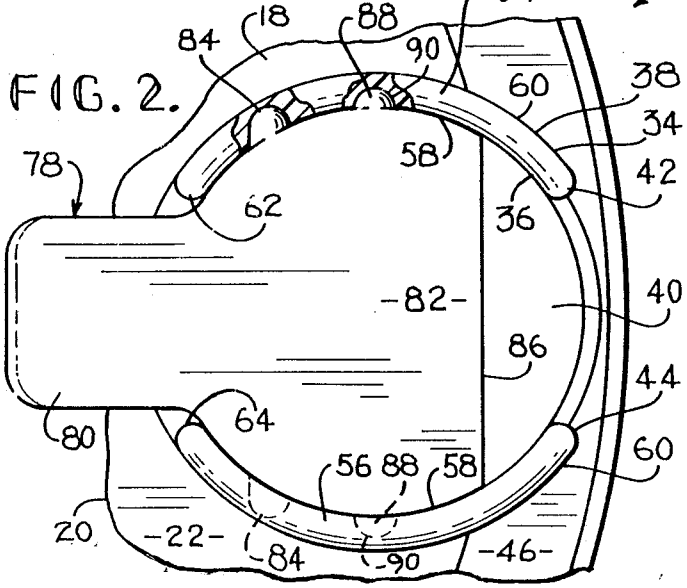
FIG. 2 is a fragmentary top plan view of the container closure with spigot valve.
Figure 3:
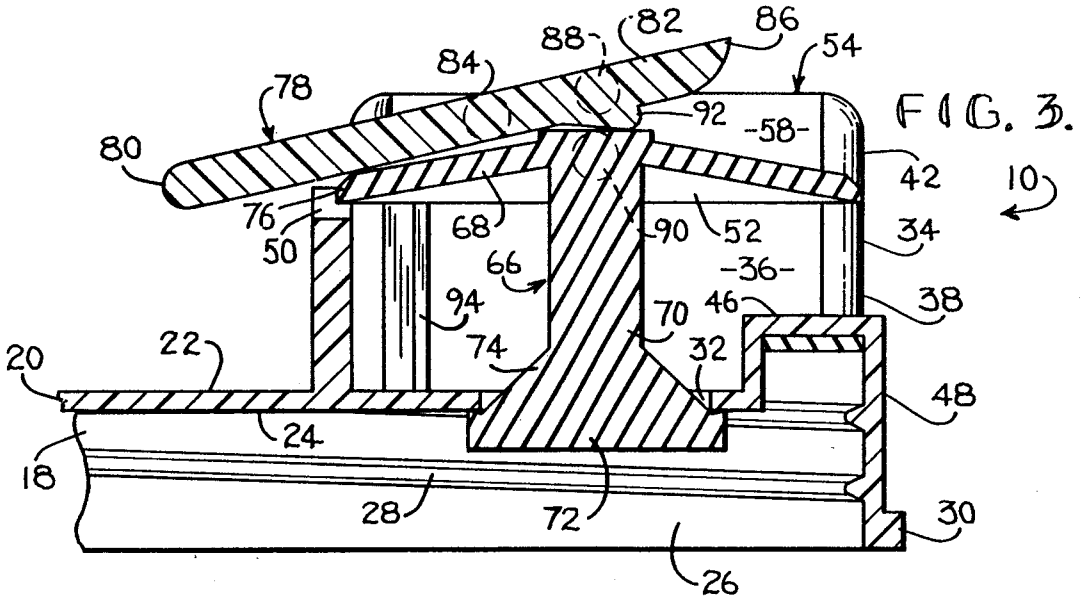
Figure 4:
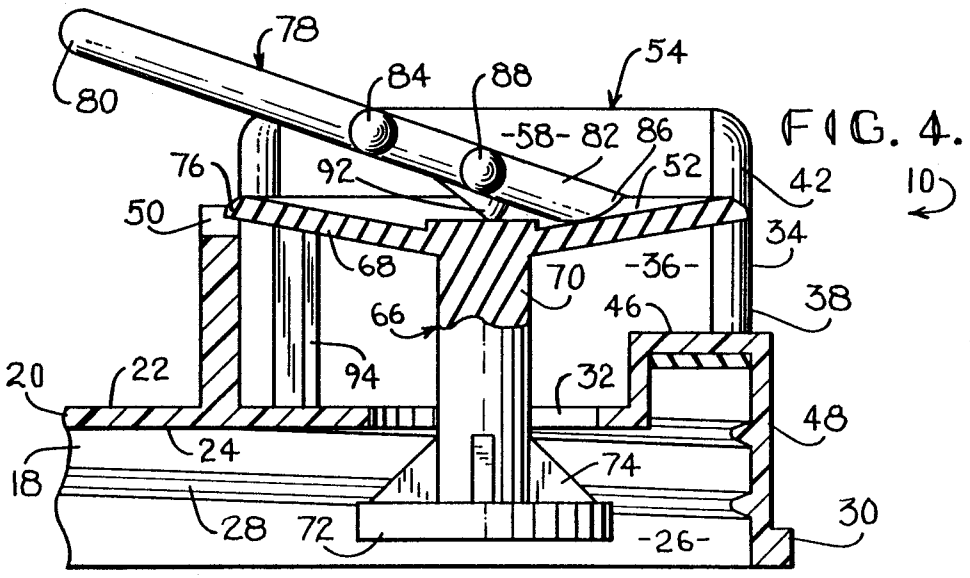
Figure 1:
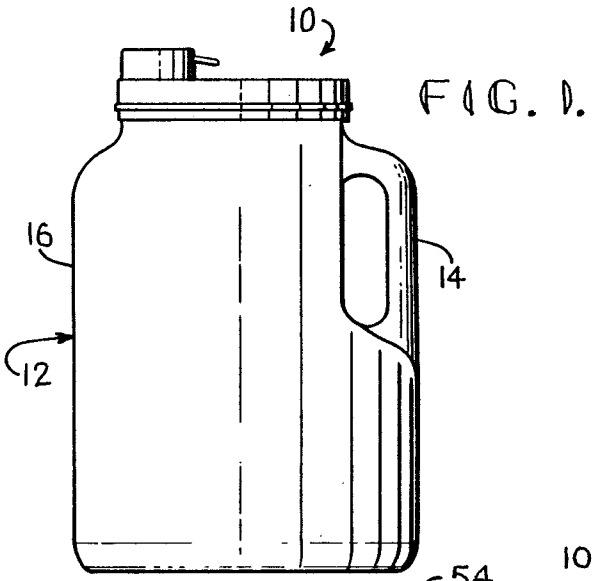
Figure 2:
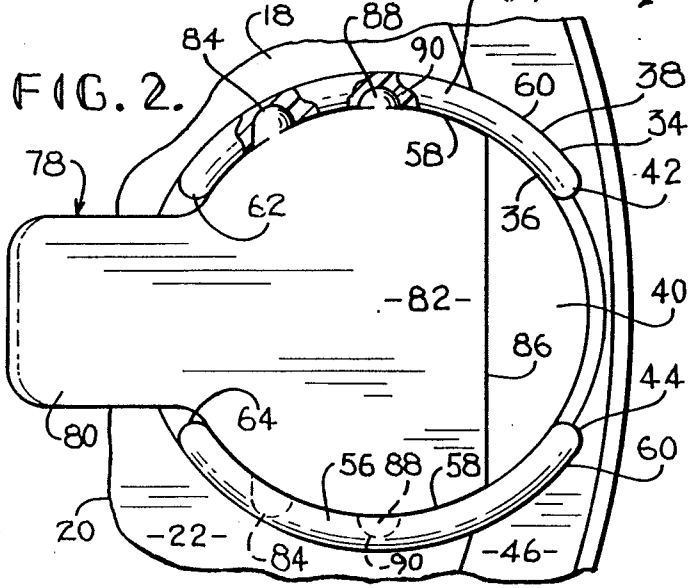

The wall 34 has a spout opening 40 in the portion thereof which is normally proximal to the front edge of the lid 18, the spout opening 40 being defined by spaced apart wall edges 42 and 44, as best seen in FIG. 2, and the uppermost face 46 of a rim 48, which circumscribes the top wall 20 of the lid 18.

The rearmost portion of the wall 34, that is, the area opposite to the spout portion 40, is provided with an air vent opening 50 whereby to permit the ingress of air as fluid egresses from spout opening 40. Thus, it will be appreciated that the wall 34 is essentially continuous from edge 42 around to edge 44, except for the provision of the air vent 50, said edges 42 and 44 being spaced apart, as shown, whereby to present the spout 40 in that area of the wall 34 which is proximal to the normally forwardmost outer edge of the lid 18.

The inner face 36 of wall 34 has a groove 52 formed therein, which is continuous throughout the circumference of the wall 34, and, particularly, its inner face 36, the groove 52 serving a purpose which will be hereinafter described.

The wall 34 has opposed arcuate segments 54 and 56 which extend upwardly beyond the groove 52, as shown in FIG. 2, the segments constituting extensions of the base wall 34, and each of the segments having an inner face 58 and an outer face 60. The segments 54 and 56 terminate at the front end of the spigot valve coincidentally with edges 42 and 44 of the base wall 34, and at the normally rearmost portion of the spigot valve the segments 54 and 56 terminate, as at edges 62 and 64, whereby to present an open area between said edges 62 and 64.

Housed essentially within the confines of wall 34 and upstanding segments 54 and 56 is the shiftable sealing assembly 66, which functions to open and close the hole 32.

The shiftable sealing assembly includes a resilient member 68, which is generally circular in configuration, whereby to conform to the area defined by wall 34 and which resilient member is made of molded rubber.

Figure 3:
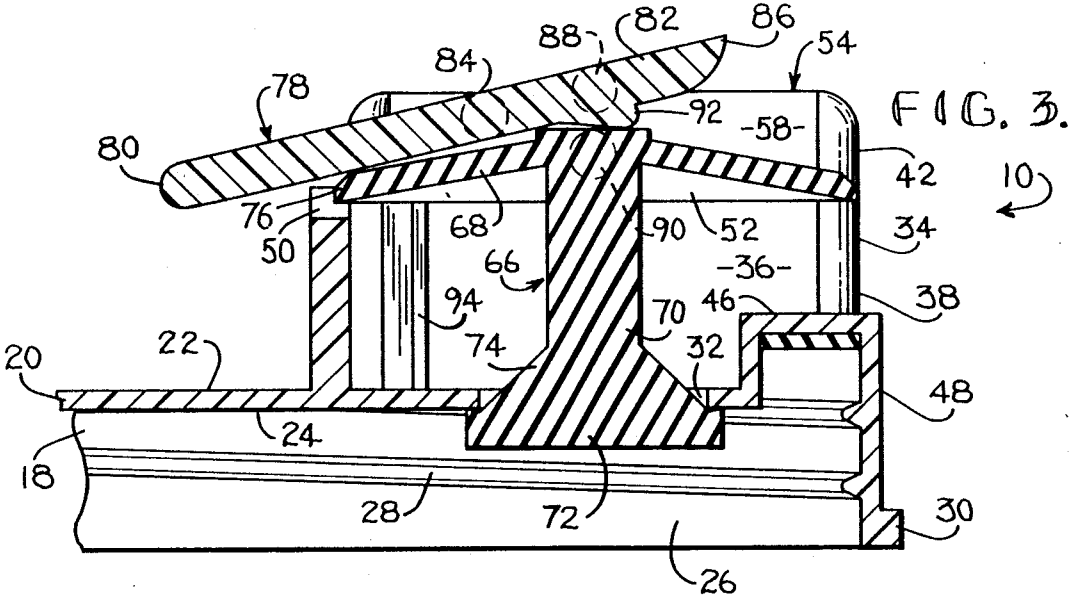
FIG. 3 is a fragmentary central sectional view of the container closure with spigot valve and showing the valve in its first position in a closed condition.
Figure 4:
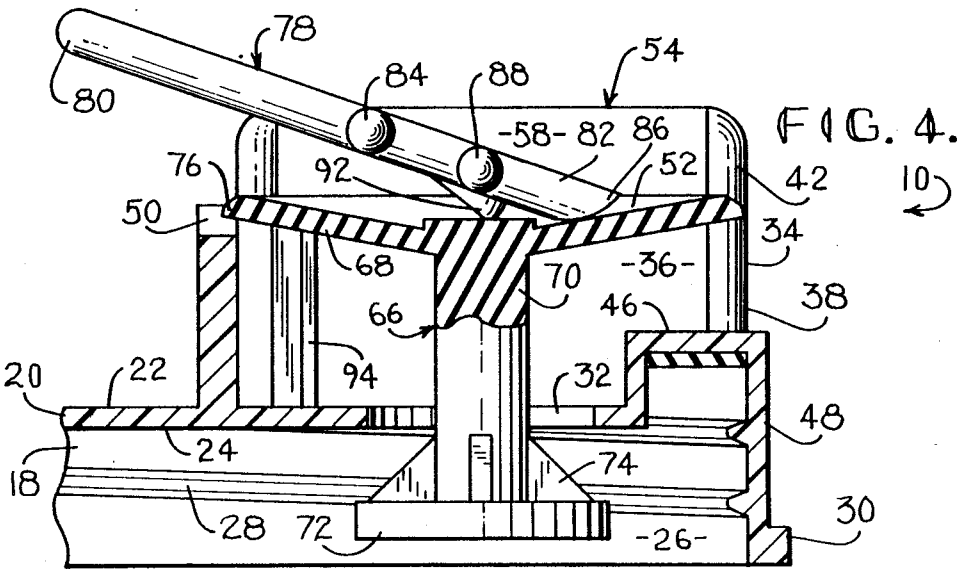
FIG. 4 is a fragmentary, partially sectional view, comparable to that of FIG. 3, but showing the container closure with spigot valve in its second position in an open condition.

A valve stem 70 is a part of the shiftable sealing assembly 66 and depends from the center of circular resilient member 68 downwardly and through the hole 32, as illustrated best in FIGS. 3 and 4. At the lowermost end of stem 70 is a sealer plate 72 which is connected with the normally lowermost end of the stem 70 and also connected therewith by a plurality of guides or gussets 74.

In order that the resilient member 68 may function as a spring to retain stem 70 and plate 72 in the desired position, the marginal edge thereof, as at 76, is seated within groove 52 whereby the resilient circular plate 68 is supported in spaced relationship from the uppermost surface 22 of the lid 18 and in spaced relationship from the hole 32.

In order to operate the valve 66, a lever 78 is provided which has a handle portion 80 and a cam portion 82, said portions being on opposite sides of a pivot point 84, which serves as a fulcrum for the lever 78. Intermediate the pivot point 84 and the outermost end 86 of the cam portion 82 are a pair of detents 88, which are on opposite sides of the cam portion 82, whereby they may cooperate with seats 90, respectively, and retain the lever 78 in its second position, as illustrated in FIG. 4, and, therefore, the valve in its open condition to permit egress of the contents of the container 12 through hole 32 and spout opening 40.

It will be noted that when lever 78 is swung to the second position, as shown in FIG. 4, it pivots about points 84 and, through its outermost end portion 86, as well as a cam 92, it engages the resilient circular member 68 thereby forcing the same downwardly to move the sealer plate 72 away from the lower face 24 of top wall 20 of lid 18 and, thus, open the hole. As shown in FIG. 2, the cam portion 82 is substantially the same in plan configuration as the configuration of the circular resilient member 68 and, when activated by swinging the lever upwardly, viewing FIG. 4 for instance, the cam portions 82 and 92 will act upon the resilient member and the uppermost end of valve stem 70, whereby to force the same downwardly.

When the lever 78 is swung to its first position, as shown in FIG. 3 of the drawing, the inherent resiliency of the rubber, spring-like, circular resilient member will cause stem 70 and plate 72 to move upwardly to the position illustrated to close hole 32. If additional support is required for member 68, a plurality of ribs, such as 94, may be provided on the inner face 36 of circumscribing wall 34, which ribs cooperate with the groove 52 to support the circular member 68 in its first position, with the valve in a closed condition, as shown in FIG. 3 of the drawing. The resilient member 68 assumes the closed, first position, as shown in FIG. 3, due to the inherent nature of the rubber from which the stem 70 and resilient member 68 are molded.

To urge the valve to an open condition in its second position, as shown in FIG. 4, the lever 78 is swung upwardly, from the position shown in FIG. 3 to that shown in FIG. 4, by utilizing handle 78. When this movement is accomplished, around pivots 84, the detents 88 move into their corresponding seats 90 to retain the lever and, therefore, the valve in the open condition whereby fluid may readily egress through spout opening 40 as air comes into the container through air vent inlet 50. Thus, a smooth flow of fluid from the container is provided.

It will be particularly appreciated that the spigot valve, as described above, when positioned on the lid of the container and when the lid is utilized as a closure for a container, such as 12, the container may be used both as a pitcher and as a stationary dispensing container. Specifically, the container may be lifted, in its generally vertical position, by handle 14 and the lever 78 activated to open the spout 40 whereby the container 12 may then be tipped as a pitcher and the contents poured into a waiting receptacle. Yet further, a container, such as 12, carrying the container closure, as hereinabove described, may be placed in a horizontal position, as by laying it upon wall 16, and the spigot valve assembly then utilized to "tap" the container and permit a flow of fluid therefrom into a receptacle placed beneath the spout opening 40.

Thus, there is provided a container closure having a spigot valve which permits the closure to be utilized on a liquid container and liquid to be dispensed from the container in either a vertical or horizontal position.

I claim:

1. A container closure having a spigot valve and comprising:

a lid for the container and having a hole therein, the spigot valve being carried by the lid in association with the hole and including:

a shiftable sealing assembly for opening and closing the hole;

resilient means forming part of the assembly and shiftable from a first position to a second position;

lever means for shifting the resilient means from said first position closing the hole to said second position opening the hole by acting upon said resilient means, said lever means overlying the resilient means and having a handle portion and a cam portion, said portions being on opposite sides of a pivot point for the lever, the cam portion being in direct engagement with the sealing assembly; and means for retaining said lever to hold the resilient means in the second position and, therefore, the hole in open condition to permit egress of the contents of the container.

2. A container closure as set forth in claim 1, wherebeing support means for said lever and said resilient means in the form of a wall circumscribing the hole and extending outwardly from said lid.

3. A container closure as set forth in claim 2, said resilient means being substantially circular and made of rubber.

4. A container closure having a spigot valve and comprising:

a lid for the container and having a hole therein, the spigot valve being carried by the lid in association with the hole and including:

a shiftable sealing assembly for opening and closing the hole;

resilient means forming part of the assembly and shiftable from a first position to a second position;

lever means for shifting the resilient means from said first position closing the hole to said second position opening the hole by acting upon said resilient means;

support means for said lever and said resilient means in the form of a wall circumscribing the hole and extending outwardly from said lid; and means for retaining said lever to hold the resilient means in the second position and, therefore, the hole in open condition to permit egress of the contents of the container, said lever having a handle portion and a cam portion, said portions being on opposite sides of a pivot point for the lever, said resilient means being substantially circular and made of rubber, said wall essentially surrounding said resilient means except for a spout formed in that area of the wall proximal to the outer edge of the lid and an air inlet aperture formed in the wall oppositely to said spout.

5. A container closure as set forth in claim 4, therebeing a groove formed in the wall and receiving therewithin at least a portion of the marginal edge of the circular resilient means whereby to support the resilient means spaced above the hole.

6. A container closure as set forth in claim 4, therebeing a valve stem extending from the resilient means through the hole, said stem being shiftable with the resilient means to open and close the hole.

7. A container closure as set forth in claim 4, the valve stem being made of rubber.

8. A container closure as set forth in claim 4, said wall having opposed segments extending upwardly beyond said groove, said segments cooperating to present the pivot points for said lever.

9. A container closure as set forth in claim 4, said segments presenting seats for receiving detents on the cam portion of the lever for retaining the lever to hold the resilient means in the second position and, therefore, the hole in an open condition to permit egress of the contents of the container.

* * * * *